US006068539A

United States Patent [19]

Bajaj et al.

[11] Patent Number: 6,068,539

[45] Date of Patent: May 30, 2000

[54] WAFER POLISHING DEVICE WITH MOVABLE WINDOW

[75] Inventors: Rajeev Bajaj, Fremont; Herbert E. Litvak, San Jose; Rahul K. Surana, Fremont; Stephen C. Jew, Sunnyvale; Jiri Pecen, Palo Alto, all of Calif.

[73] Assignee: Lam Research Corporation, Fremont, Calif.

[21] Appl. No.: 09/038,171

[22] Filed: Mar. 10, 1998

[51] Int. Cl.[7] ..... B24B 7/22

[52] U.S. Cl. ..... 451/6; 451/41

[58] Field of Search ..... 451/6, 8, 41, 287, 451/288, 527, 530, 533, 921

[56] References Cited

U.S. PATENT DOCUMENTS

| | | |
|---|---|---|
| 3,841,031 | 10/1974 | Walsh . |
| 4,193,226 | 3/1980 | Gill, Jr. et al. . |
| 4,308,586 | 12/1981 | Coates . |
| 4,462,860 | 7/1984 | Szmanda . |
| 4,516,855 | 5/1985 | Korth . |
| 4,647,207 | 3/1987 | Bjork et al. . |
| 4,653,924 | 3/1987 | Itonaga et al. . |
| 4,681,450 | 7/1987 | Azzam . |
| 4,776,695 | 10/1988 | van Pham et al. . |
| 4,793,895 | 12/1988 | Kaanta et al. . |
| 4,811,522 | 3/1989 | Gill, Jr. . |
| 4,844,617 | 7/1989 | Kelderman et al. . |
| 4,927,432 | 5/1990 | Budinger et al. . |
| 4,954,141 | 9/1990 | Takiyama et al. . |
| 4,957,368 | 9/1990 | Smith . |
| 5,020,283 | 6/1991 | Tuttle . |
| 5,036,015 | 7/1991 | Sandhu et al. . |
| 5,042,951 | 8/1991 | Gold et al. . |

(List continued on next page.)

FOREIGN PATENT DOCUMENTS

| | | |
|---|---|---|
| 0663265 | 7/1995 | European Pat. Off. . |
| 0 738 561 A1 | 10/1996 | European Pat. Off. . |
| WO 94/04599 | 3/1994 | WIPO . |
| WO 95/18353 | 6/1995 | WIPO . |
| WO 96/36459 | 5/1996 | WIPO . |

OTHER PUBLICATIONS

European Search Report for European Patent Application EP98304224.3, (3 pp.).

Hariharan, P., "Optical Interferometry" Academic Press, Sydney, pp. V–XI, 1–9, 37–95 (1985).

Steel, W.H., "Interferometry," Cambridge University Press, Cambridge, pp. V–XI, 26–59, 232–251 (1983).

T. Cleary and C. Barnes, "Orbital Polishing Techniques for CMP," Proceedings of 1996 VMIC Conference, p. 443 (Jun. 1996).

Holger, Grahn, Maris & Tauc, "Picosecond Ultrasonics," IEEE Journal of Quantum Electronics, vol. 25, No. 12, pp. 2562–2569 (Dec. 1989).

Parikh et al., "Oxide CMP on High–Throughput Orbital Polisher," Feb. 13–14, 1997 CMP–MIC Conference.

Fanton, et al., "Multiparameter Measurements of Thin Films Using Beam–Profile Reflectometry," Journal of Applied Physics, vol. 73, No. 11, pp. 7035–7040 Jun. 1, 1993.

Fanton, et al., "A Novel Technique for Performing Ellipsometric Measurements in a Sub–Micrometer Area.".

OPTI–PROBE™ Brochure, Therma–Wave, Inc., 1995.

*Primary Examiner*—Robert A. Rose

*Attorney, Agent, or Firm*—Brinks Hofer Gilson & Lione

[57] ABSTRACT

A wafer polishing device with movable window can be used for in-situ monitoring of a wafer during CMP processing. During most of the CMP operation, the window remains below a polishing surface of a polishing device to protect the window from the deleterious effects of the polishing process. When the window moves into position between the wafer and a measurement sensor, the window is moved closer to the polishing surface. In this position, at least some polishing agent collected in the recess above the window is removed, and an in-situ measurement can be taken with reduced interference from the polishing agent. After the window is positioned away from the wafer and measurement sensor, the window moves farther away from the wafer and polishing surface. With such a movable window, the limitations of current polishing devices are overcome.

35 Claims, 4 Drawing Sheets

U.S. PATENT DOCUMENTS 5,061,072 10/1991 Folkard et al. .
5,067,805 11/1991 Corle et al. .
5,081,421 1/1992 Miller et al. .
5,081,796 1/1992 Schultz .
5,166,752 11/1992 Spanier et al. .
5,177,908 1/1993 Tuttle .
5,197,999 3/1993 Thomas .
5,213,655 5/1993 Leach et al. .
5,240,552 8/1993 Yu et al. .
5,297,364 3/1994 Tuttle .
5,306,916 4/1994 Norton et al. .
5,308,438 5/1994 Cote et al. .
5,321,304 6/1994 Rostoker .
5,329,732 7/1994 Karlsrud et al. .
5,337,015 8/1994 Lustig et al. .
5,413,941 5/1995 Koos et al. .
5,433,650 7/1995 Winebarger .
5,433,651 7/1995 Lustig et al. .
5,439,551 8/1995 Meikle et al. .
5,461,007 10/1995 Kobayashi .
5,486,701 1/1996 Norton et al. .
5,489,233 2/1996 Cook et al. .
5,517,312 5/1996 Finarov .
5,554,064 9/1996 Breivogel et al. .
5,558,568 9/1996 Talieh et al. .
5,595,526 1/1997 Yau et al. .
5,597,442 1/1997 Chen et al. .
5,605,760 2/1997 Roberts .
5,643,044 7/1997 Lund .
5,658,183 8/1997 Sandhu et al. .
5,762,536 6/1998 Pant et al. ..... 451/6
5,816,891 10/1998 Woo .
5,838,447 11/1998 Hiyama et al. .

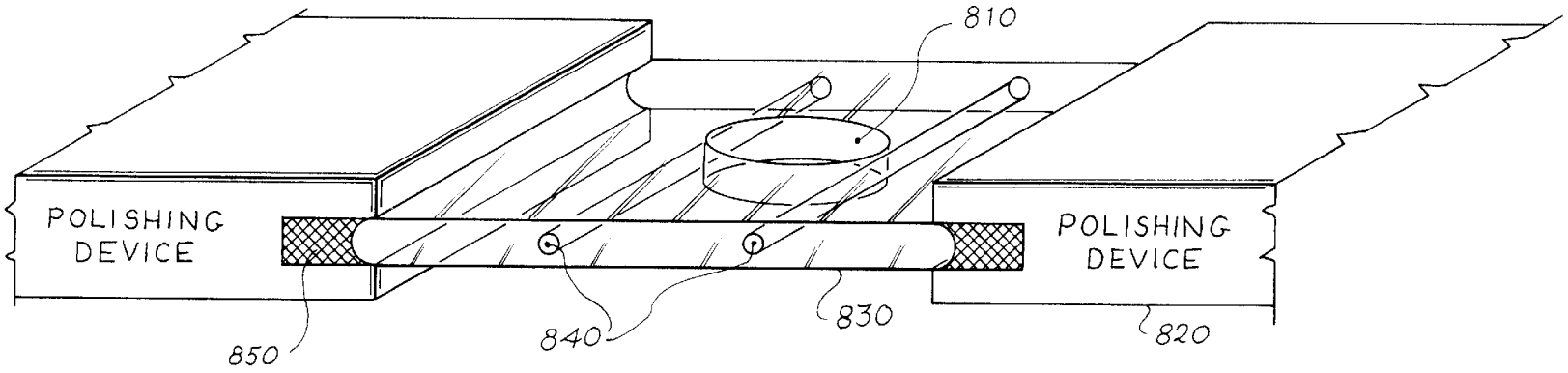
Fig. 8
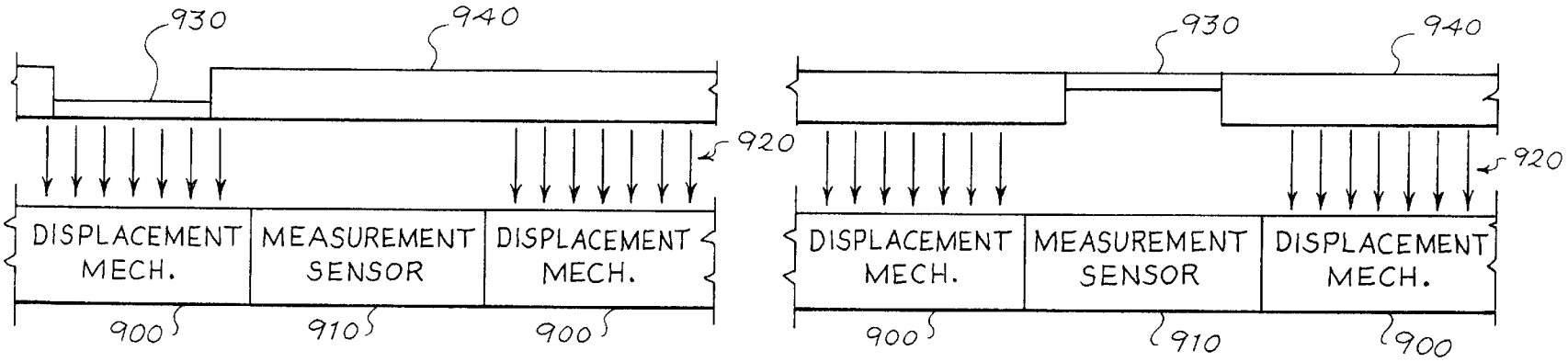
Fig. 10
Fig. 9

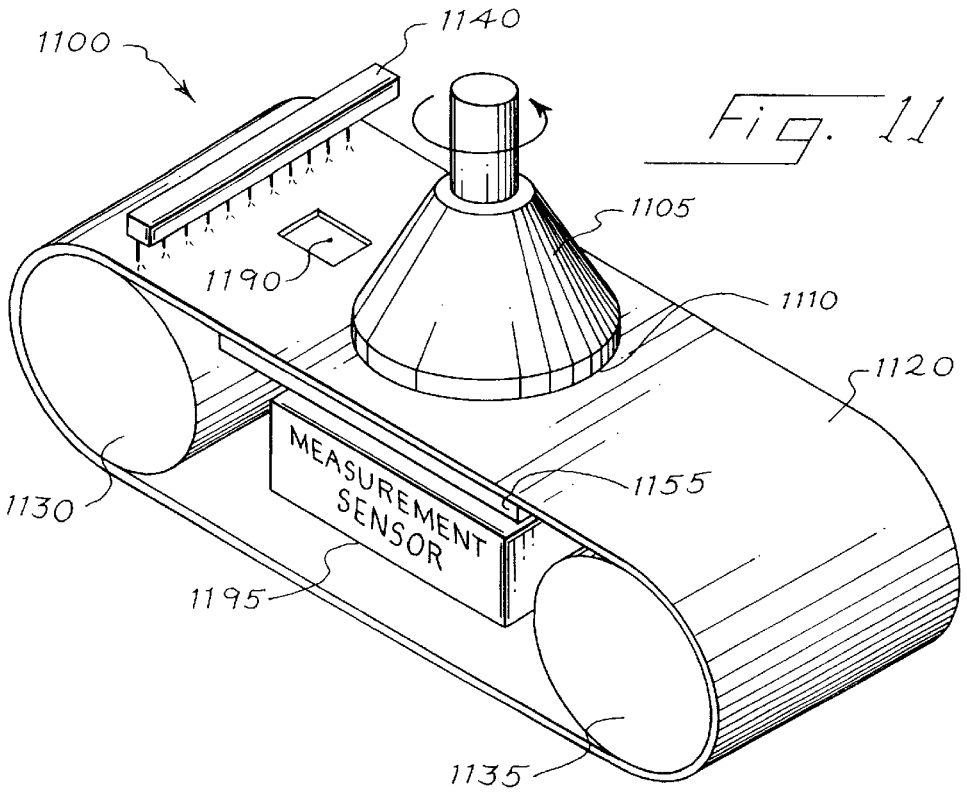
Fig. 11
Fig. 12
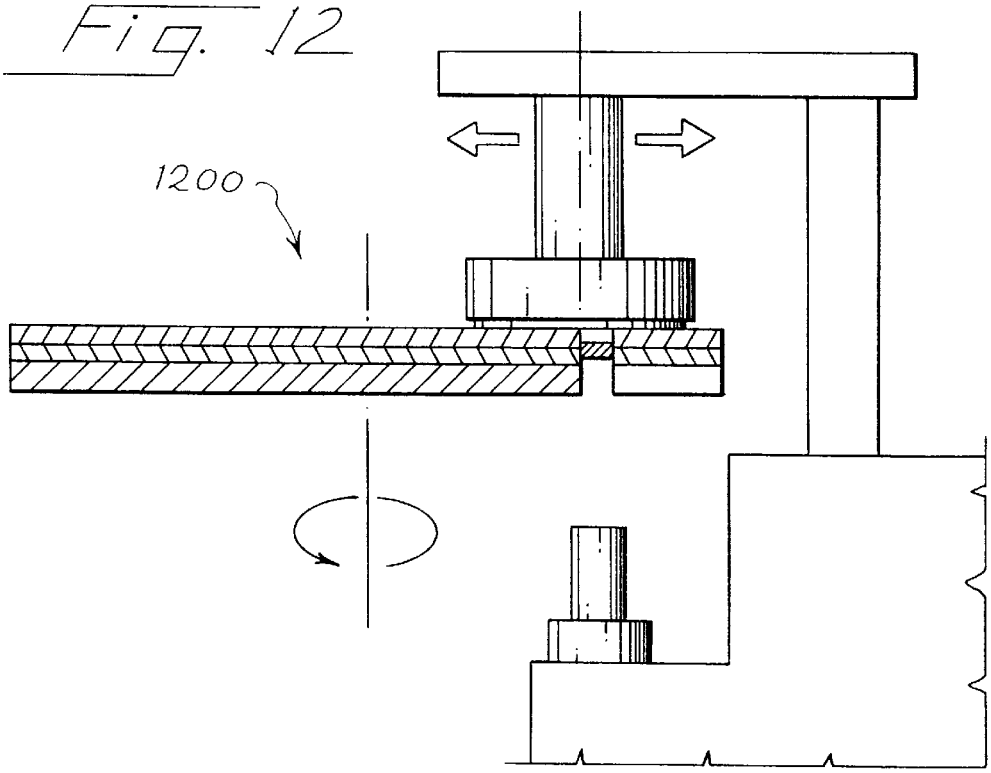

WAFER POLISHING DEVICE WITH MOVABLE WINDOW

BACKGROUND

Chemical-mechanical polishing (CMP) is a well-known technique for removing materials on a semiconductor wafer using a polishing device and a polishing agent. The mechanical movement of the polishing device relative to the wafer in combination with the chemical reaction of the polishing agent provide an abrasive force with chemical erosion to planarize the exposed surface of the wafer or a layer formed on the wafer. Rotating, orbital, and linear polishers are three types of tools that can be used in the CMP process. With a rotating polisher, a rotating wafer holder supports a wafer, and a polishing pad on a moving platen rotates relative to the wafer surface. In contrast, the platen of an orbital polisher orbits as opposed to rotates during polishing. With a linear polisher, a flexible belt moves a polishing pad linearly across a wafer surface, providing a more uniform velocity profile across the surface of the wafer as compared to rotating or orbital polishers.

CMP polishers can incorporate various in-situ monitoring techniques to monitor the polished surface of the wafer to determine the end point of the polishing process. U.S. Pat. No. 5,433,651 and European Patent Application No. EP 0 738 561 A1 describe rotating polishers that are designed for in-situ monitoring. In the '651 patent, a rotating polishing platen has a fixed window, which is flush with the platen but not with the polishing pad on the platen. As the platen rotates, the window passes over an in-situ monitor, which takes a reflectance measurement indicative of the end point of the polishing process. Because the top surface of the window is below the top surface of the polishing pad, polishing agent collects in the recess above the window, adversely affecting the measurement by scattering light traveling through the window.

European Patent Application No. EP 0 738 561 A1 discloses a rotating polishing platen with a fixed window, which, unlike the one in the '651 patent, is substantially flush with or formed from the polishing pad. Because the top surface of the window is in the same plane as the top surface of the polishing pad during the entire polishing process, the optical transparency of the window can be damaged when the wafer slides over the window and when pad conditioners cut small groves across the polishing pad. Since the window is not replaceable, once the window is damaged, the entire pad-window polishing device must be replaced even if the polishing pad itself does not need to be replaced.

There is a need, therefore, for an improved wafer polishing device that will overcome the problems described above.

SUMMARY

The present invention is defined by the following claims, and nothing in this section should be taken as a limitation on those claims.

By way of introduction, the preferred embodiments described below include a polishing device that can be used for in-situ monitoring of a wafer during CMP processing. Unlike polishing devices that contain fixed windows, the polishing devices of these preferred embodiments contain a movable window. During most of the CMP operation, the window remains in a position away from the polishing surface of the polishing device to protect the window from the deleterious effects of the polishing process. When the polishing device positions the window between the wafer and a measurement sensor, the window moves to a position closer to the polishing surface of the polishing device. In this position, at least some polishing agent collected in the recess between the window and polishing surface is removed, and an in-situ measurement can be taken with reduced interference. After the polishing device positions the window away from the wafer and measurement sensor, the window returns to a position farther away from the polishing surface of the polishing device.

The preferred embodiments will now be described with reference to the attached drawings.

BRIEF DESCRIPTION OF THE DRAWINGS

FIG. 8 is an illustration of a polishing device of a preferred embodiment in which a magnet and a set of conductors are operative to move a window from a first to a second position.

FIG. 9 is an illustration of a polishing device of a preferred embodiment in which a movable window is drawn towards a window displacement mechanism.

FIG. 10 is an illustration of a polishing device of a preferred embodiment in which a movable window is moved closer to a polishing surface when the window is positioned away from a window displacement mechanism.

FIG. 11 is an illustration of a linear polishing tool of a preferred embodiment.

FIG. 12 is an illustration of a rotating polishing tool of a preferred embodiment.

DETAILED DESCRIPTION OF THE PRESENTLY PREFERRED EMBODIMENTS

Figure 1:
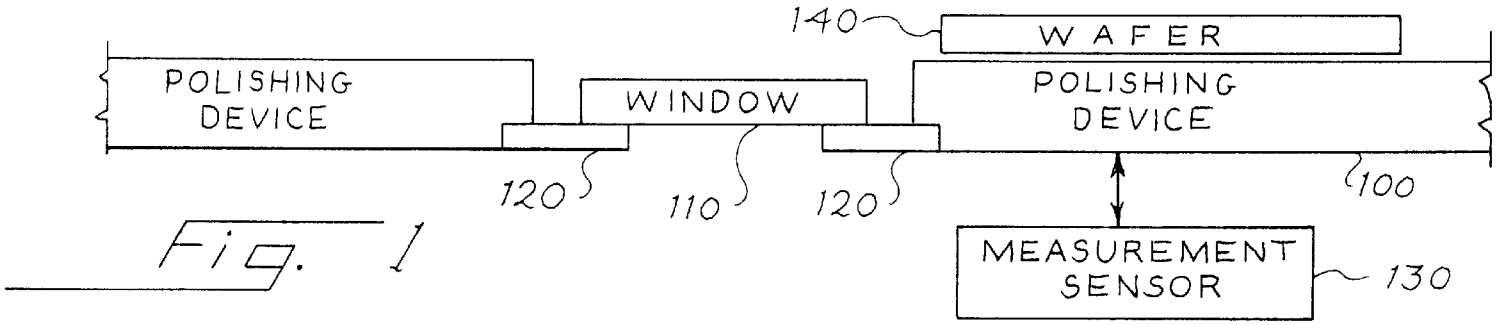
FIG. 1 is an illustration of a polishing device of a preferred embodiment with a movable window in a first position.
Figure 2:
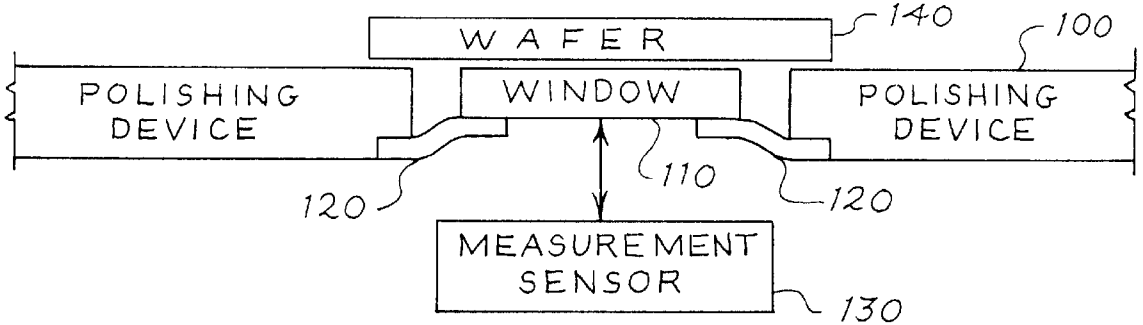
FIG. 2 is an illustration of a polishing device of a preferred embodiment with a movable window in a position closer to a polishing surface of the polishing device.

Turning now to the drawings, FIGS. 1 and 2 illustrate a polishing device 100 of a preferred embodiment that can be used for in-situ monitoring of a wafer during CMP processing. As shown in these figures, a polishing device 100 comprises an opening, which is filled by a window 110 affixed to the polishing device 100 by a flexible diaphragm 120. Located above the polishing device 100 is a wafer 140 undergoing CMP, and located below the polishing device 100 is a measurement sensor 130 for performing in-situ monitoring of the wafer 140 during CMP. For simplicity, the term "polishing device" in this specification and the following claims is intended broadly to encompass any device capable of performing CMP processing on a semiconductor wafer. A "polishing device" comprises a polishing surface, which is typically a polishing pad integrated with or affixed to the top of a polishing device subassembly. Polishing devices include, but are not limited to, a polishing pad and belt used in a linear polisher, a polishing pad and movable platen used in a rotating polisher, and a polishing pad and movable platen used in an orbital polisher.

Unlike conventional polishing devices that contain fixed windows for in-situ monitoring, the polishing device 100 of FIGS. 1 and 2 comprises a window 110 that is movable from a first position to a second position. During some or most of the polishing process, the window 110 is positioned away from the wafer 140 and the polishing surface of the-polishing device 100 (FIG. 1). At or before the time when the polishing device 100 positions the window 110 at a measurement location between the wafer 140 and the measurement sensor 130, the window 110 is moved to a position closer to the polishing surface of the polishing device 100 (FIG. 2). It is preferred that the top surface of the window 110 be substantially flush with the top surface of the polishing device 100 when the window 110 is in the second position. With the window 110 moved to a position closer to the polishing surface of the polishing device 100, the measurement sensor 130 takes a measurement of the surface of the wafer 140 through the window 110. After the polishing device 100 moves the window 110 away from the measurement location, the window 110 is returned to a position farther away from the polishing surface of the polishing device 100.

Because the polishing device 100 has a movable window 110, the problems associated with the prior art are overcome. Specifically, because the window 10 is below the polishing surface of the polishing device 100 for some or most of the CMP process, the window 110 is not damaged by the deleterious effects of the polishing process. By being below the polishing surface of the polishing device 100, the optical transparency of the window 110 is not damaged by conditioners that cut small grooves across the polishing surface during CMP to enhance the polishing operation. Further, because the window 110 moves closer to the polishing surface when a wafer measurement it taken, at least some polishing agent collected in the recess between the window 110 and polishing surface is removed, and an in-situ measurement can be taken with reduced interference. Additionally, in contrast to the fixed windows of prior art polishing devices, the window 110 of this preferred embodiment is easily replaceable. Since the window is easily replaceable, it alone, instead of the entire polishing device, can be replaced when the optical transparency of the window deteriorates.

In the preferred embodiment shown in FIGS. 1 and 2, the window 110 is movably mounted to the polishing device by a flexible diaphragm 120. Preferably, the window 110 is made from urethane. It is important to note that a single urethane (preferably aromatic or aliphatic) or a combination of urethanes can be used. It is preferred that the window 110 have an area of about 1 to 100 $cm^2$, a thickness of about 0.002 to 0.050 inches (most preferably about 0.010 to 0.015 inches), a hardness of about 25 Shore A to 75 Shore D (most preferably about 45 Shore D), and high optical transmission for ultraviolet and infrared light (about 200 to 1200 nm, most preferably about 300 to 800 nm). It is preferred that the first surface of the window be coated with a slurry-phobic material, such as a silicone, lyophilic or hydrophobic material.

The flexible diaphragm 120 is made preferably from a latex or natural rubber, although any other material that provides enough lift to remove polishing agent from the recess above the window 110 can be used. It is preferred that the flexible diaphragm 120 have an area of about 1 to 100 $cm^2$ (most preferably about 25 $cm^2$) and a thickness of about 0.001 to 0.040 inches (most preferably about 0.008 inches). Preferably, a hole is made in the flexible diaphragm 120 about the size of the window 110, and the edges of the window 110 are affixed to the flexible diaphragm 120 using about a 0.001 to 0.020 inch-thick layer (most preferably a 0.005 inch-thick layer) of urethane epoxy. The flexible diaphragm/window component then can be affixed to the polishing device using any suitable glue. In the polishing device shown in FIGS. 1 and 2, the flexible diaphragm 120 is glued into a recess in the polishing device 100.

Figure 3:
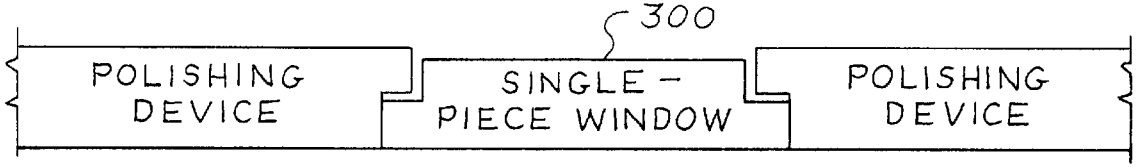
FIG. 3 is an illustration of a polishing device of a preferred embodiment comprising a single-piece flexible window.

As an alternative to the configuration shown in FIGS. 1 and 2, a single-piece window 300 (FIG. 3) with the appropriate optical and flexibility characteristics can be used. It is preferred that the single-piece window 300 be made of urethane and have high optical transmission for ultraviolet and infrared light (about 200 to 1200 nm, most preferably about 300 to 800 nm). It is further preferred that the center of the single-piece window 300 have a thickness of about 0.002 to 0.050 inches (most preferably about 0.010 to 0.015 inches) and that the edge flange of the single-piece window 300 have a thickness of about 0.001 to 0.040 inches (most preferably about 0.006 inches). In operation, when positioned under the wafer, the single-piece window 300 flexes toward the polishing surface of the polishing device, and a measurement sensor takes a measurement of the surface of the wafer through the single-piece window 300. After the polishing device moves the single-piece window 300 away from the measurement location, the single-piece window 300 returns to a position farther away from the polishing surface of the polishing device.

Figure 4:
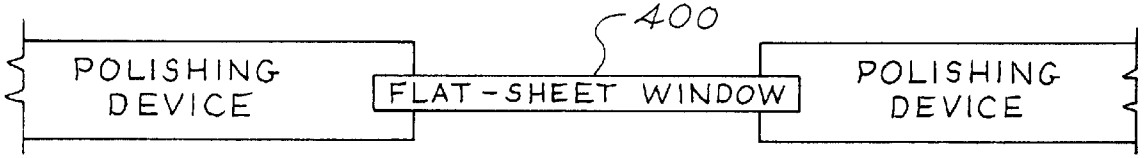
FIG. 4 is an illustration of a polishing device of a preferred embodiment comprising a flat-sheet flexible window.

In another alternative, shown in FIG. 4, a flat-sheet window 400 is used. It is preferred that the flat-sheet window 400 be made of urethane, have high optical transmission for ultraviolet and infrared light (about 200 to 1200 nm, most preferably about 300 to 800 nm), and have a thickness of about 0.002 to 0.050 inches (most preferably about 0.010 inches). In operation, when positioned under the wafer, the flat-sheet window 400 flexes toward the polishing surface of the polishing device, and a measurement sensor takes a measurement of the surface of the wafer through the flat-sheet window 400. After the polishing device moves the flat-sheet window 400 away from the measurement location, the flat-sheet window 400 returns to a position farther away from the polishing surface of the polishing device.

Figure 5:
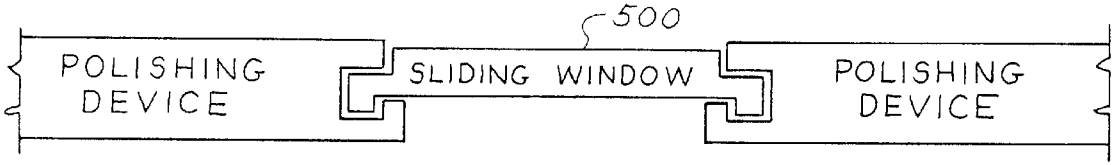
FIG. 5 is an illustration of a polishing device of a preferred embodiment comprising a sliding window.

FIG. 5 illustrates another alternative in which a sliding window 500 is used. When positioned under the wafer, the sliding window 500 slides closer to the polishing surface of the polishing device. After the polishing device moves the sliding window 500 away from the measurement location, the sliding window 500 slides back to a position farther away from the polishing surface of the polishing device. In the embodiment shown in FIG. 5, the polishing device is shaped to retain the sliding window 500 as it slides closer to and farther away from the polishing surface of the polishing device.

Figure 6:
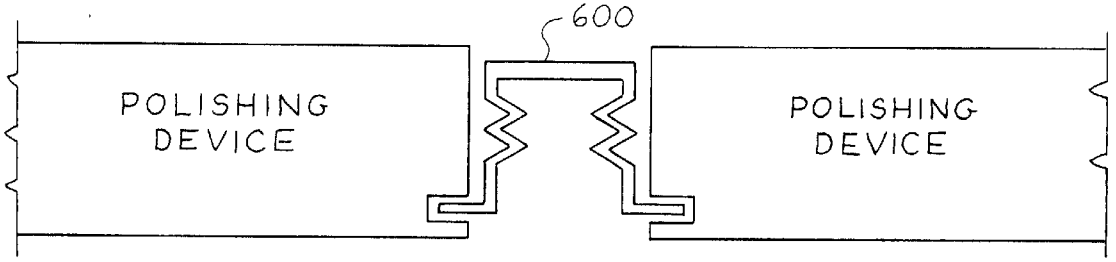
FIG. 6 is an illustration of a polishing device of a preferred embodiment comprising a bellows window.

FIG. 6 illustrates another preferred embodiment in which a bellows window 600 is employed. When the bellows window 600 moves into a measurement location under the wafer, the bellows window 600 extends closer to the polishing surface of the polishing device. When the bellows window 600 moves away from the measurement location, it returns to a position farther away from the polishing surface of the polishing device.

It is important to note that the above-described windows are only a few of the many forms that can be used and that any window construction that allows the window to move closer to the polishing surface is encompassed by this invention. Further, any window size or shape can be used. It is preferred, however, that, when the window is not moved closer to the polishing surface, the window be positioned below the grooves created by a polishing-device conditioner. (In a polishing pad with a thickness of 50 mils, the grooves are typically 20 mils thick.)

Figure 7:
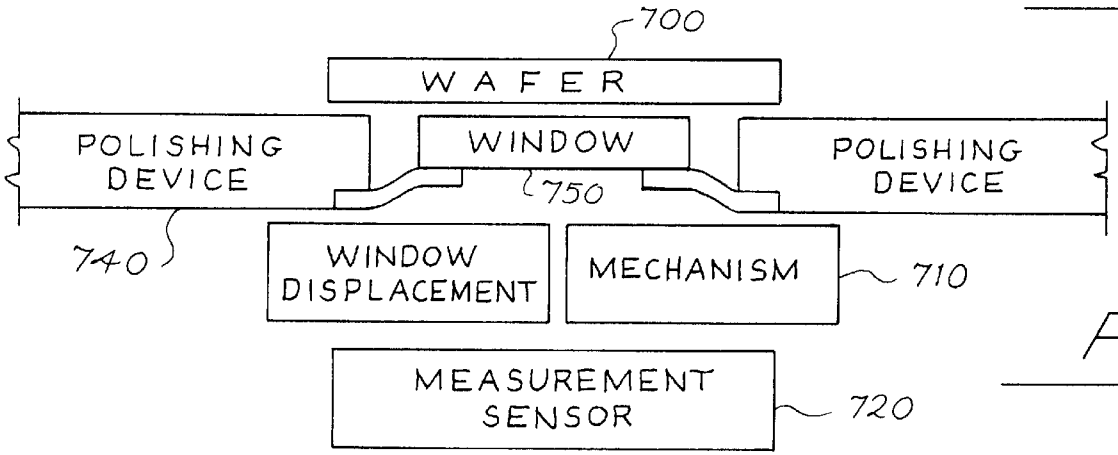
FIG. 7 is an illustration of a polishing device of a preferred embodiment in which a window displacement mechanism is disposed over a measurement sensor.

The window can be moved from the first to the second position with any suitable means. In one preferred embodiment (shown in FIG. 7), a window displacement mechanism 710 is positioned beneath the polishing device 740 near the measurement sensor 720. As shown in FIG. 7, the window displacement mechanism 710 is positioned above the measurement sensor 720 and contains an opening through which the measurement sensor 720 can monitor the wafer 730. Alternatively, the measurement sensor 720 can be positioned above or adjacent to the window displacement mechanism 710. Of course, other arrangements are possible. When the polishing device 740 positions the window 750 over the window displacement mechanism 710, the window displacement mechanism 710 moves the window 750 closer to the polishing surface of the polishing device 740. After the polishing device 740 positions the window 750 away from the window displacement mechanism 710, the resilient nature of the diaphragm or window causes the window 750 to return to a position farther away from the wafer 730 and the polishing surface of the polishing device 740. Alternatively, a second window displacement mechanism can be used to lower the window 750 away from the polishing surface.

The window displacement mechanism can take any number of different forms. By way of example only, the window displacement mechanism can employ air pressure, water pressure, pressure from mechanical attachments, electromagnetic pressure, or any combination thereof It is preferred, however, that the window displacement mechanism be a fluid platen. Fluid platens are described in a patent application titled "Control Of Chemical-Mechanical Polishing Rate Across A Wafer Surface For A Linear Polisher;" Ser. No. 08/638,462; filed Apr. 26, 1996 and in U.S. Pat. Nos. 5,558,568 and 5,593,344, all of which are hereby incorporated by reference.

In an alternative embodiment, the window displacement mechanism is disposed at least partially in the polishing device. In one such alternative embodiment (shown in FIG. 8), a window 810 and a flexible member 830 comprising a set of current-carrying conductors 840 are disposed in a polishing device 820. Although two conductors are shown in FIG. 8, it is important to note that fewer or more conductors can be used. A magnet 850 disposed in the polishing device 820 creates a magnetic field across the set of current carrying conductors 840. When current is caused to flow through the conductors 840, electromagnetic forces on the conductors 840 move the flexible member 830 and the window 810 closer or farther away from the polishing surface of the polishing device 820, depending on the direction of the current flow. Current can be applied to the conductors 840 from an external source (not shown) when the window 810 moves between a wafer and a measurement sensor, as detected by a position sensor, such as, but not limited to, a Hall-effect sensor, eddy-current sensor, optical interrupter, acoustic sensor, or optical sensor.

With the embodiments described above, the rest position of the window is away from the polishing surface. In an alternative embodiment, the rest position of the window is can be in a position closer to the polishing surface, and a window displacement mechanism can be used to move the window away from the polishing surface at the appropriate time (e.g., when the window is located at a pad-conditioning station). As shown in FIGS. 9 and 10, a window displacement mechanism 900 is disposed on either side of a measurement sensor 910. The window displacement mechanism 900 can comprise any suitable mechanism (such as a vacuum or a magnet, for example) to generate a displacement force 920. The displacement force 920 draws the window 930 away from the polishing surface when the polishing device 940 positions the window 930 over the window displacement mechanism 900. When the polishing device 940 positions the window 930 between the wafer (not shown) and the measurement sensor 910 (a location in which there is no window displacement mechanism 900), the window 930 is allowed to move to its rest position closer to the polishing surface, as shown in FIG. 10. After the polishing device 940 positions the window 930 away from the measurement sensor 910 and again over the window displacement mechanism 900, the window 930 is again drawn farther away from the polishing surface (FIG. 9). Such a mechanism would be particularly useful to move the window safely below the pad cutting surface of the pad conditioner.

In yet another alternate embodiment, a first displacement force is used to position the window closer to (or farther away from) the polishing surface. The window remains in this position (even it the window is moved into or out of the measurement location) until a second displacement force moves the window farther way from (or closer to) the polishing surface. In this way, the window would act as a flip-flop.

The preferred embodiments described above can be used in linear, rotating, and orbital polishing devices. The following is a detailed discussion of a preferred linear polishing device. It is important to note that the principles described below can be readily adapted to rotating and orbital polishing devices. FIG. 11 is an illustration of a preferred embodiment in which the polishing device includes a belt 1120 on a linear polisher 1100, and the window displacement mechanism includes a fluid platen 1155. As shown in this figure, the linear polisher 1100 has a wafer carrier 1110 attached to a polishing head 1105 that secures the wafer with a mechanical retaining means, such as a retainer ring and/or a vacuum. It is preferred that a carrier film such as that available from Rodel (DF200) be used between the wafer and the wafer carrier 1110. The wafer carrier 1110 rotates the wafer over the belt 1120, which moves about first and second rollers 1130 and 1135. The rollers 1130, 1135 are preferably between about 2 to 40 inches in diameter. Driving means, such as a motor (not shown), rotates the rollers 1130, 1135, causing the belt 1120 to move in a linear motion with respect to the surface of the wafer. Preferably, the belt 1120 moves at a rate of about 200 to 1000 ft/minute (most preferably about 400 ft/minute). As used herein, "belt" refers to a closed-loop element comprising at least one layer including a layer of polishing material. A discussion of the layer(s) of the belt element is developed below. It is preferred that the belt 1120 have a width of 13 inches and be tensioned with a force of about 600 lbs.

As the belt 1120 moves in a linear direction, a polishing agent dispensing mechanism 1140 provides polishing agent to the belt 1120, preferably at a flow rate of about 100 to 300 ml/minute. The polishing agent preferably has a pH of about 1.5 to about 12. One type of polishing agent that can be used is Klebesol available from Hoechst, although other types of polishing agent can be used depending on the application.

The polishing agent moves under the wafer along with the belt 1120 and may be in partial or complete contact with the wafer at any instant in time during the polishing process. A conditioner (such as those available from Niabraze Corporation and TBW Industries, Inc.) can be used to recondition the belt 1120 during use by scratching the belt 1120 to remove polishing agent residue build-up and/or pad deformation.

The belt 1120 moves between the fluid platen 1155 and the wafer. It is preferred that the fluid platen 1155 have an air bearing and have about 1–30 fluid flow channels. It also is preferred that a pre-wet layer of de-ionized water mist be used between the platen 1155 and the belt 1120 to prevent blockage of the flow channels by any polishing agent that comes underneath the belt 1120. The fluid platen 1155 provides a supporting platform on the underside of the belt 1120 to ensure that the belt 1120 makes sufficient contact with the wafer for uniform polishing. The wafer carrier 1110 presses downward against the belt 1120 with appropriate force (preferably about 5 psi) so that the belt 1120 makes sufficient contact with the wafer for performing CMP. Since the belt 1120 is flexible and has a tendency to move downwardly when the wafer presses downwardly onto it, the fluid platen 1155 provides a necessary counteracting support to this downward force. The fluid platen 1155 can be used to control forces exerted against the underside of the belt 1120. By such fluid flow control, pressure variations exerted by the belt 1120 on the wafer can be controlled to provide a more uniform polishing rate of the wafer.

The belt 1120 contains a movable window 1190 as described above. As the belt 1120 moves linearly under the wafer during the CMP process, the movable window 1190 passes under the wafer carrier 1105 and over the fluid platen 1155 and a measurement sensor 1195. When the window 1190 moves over the fluid platen 1155, fluid from the platen 1155 lifts the window 1190 closer to the polishing surface of the belt 1120, preferably so that the window 1190 is substantially flush with the polishing surface. Additionally, when the window 1190 is between the wafer and the measurement sensor 1195, an optical circuit is completed, and in-situ monitoring can be performed. Preferably, a short-distance diffuse reflex sensor (such as a Sunx model number CX-24 sensor) enables operation of the measurement sensor.

As mentioned above, a "belt" comprises at least one layer of material, including a layer of polishing material. There are several ways in which to construct a belt. One way uses a stainless steel belt, which can be purchased from Belt Technologies, having a width of about 14 inches and a length of about 93.7 inches, inner diameter. In addition to stainless steel, a base layer selected from the group consisting of aramid, cotton, metal, metal alloys, or polymers can be used. The preferred construction of this multi-layered belt is as follows.

The stainless steel belt is placed on the set of rollers of the CMP machine and is put under about 2,000 lbs of tension. When the stainless steel belt is under tension, a layer of polishing material, preferably Rodel's IC 1000 polishing pad, is placed on the tensioned stainless steel belt. The subassembly is them removed from the rollers and an underpad, preferably made of PVC, is attached to the underside of the stainless steel belt with an adhesive capable of withstanding the conditions of the CMP process. The constructed belt preferably will have a total thickness of about 90 mils: about 50 mils of which is the layer of polishing material, about 20 mils of which is the stainless steel belt, and about 20 mils of which is the PVC underpad.

The above-described construction requires technicians and time to place the pad on the stainless steel belt. As an alternative, the belt can be formed as one integrated component as described in a patent application titled "Integrated Pad and Belt for Chemical Mechanical Polishing," Ser. No. 08/800,373, filed Feb. 14, 1997, hereby incorporated by reference. This belt is formed around a woven Kevlar fabric. It has been found that a 16/3 Kevlar, 1500 Denier fill and a 16/2 cotton, 650 Denier warp provide the best weave characteristics. As is well known in the art, "fill" is yarn in the tension-bearing direction, and "warp" is yarn in the direction perpendicular to the tension bearing direction. "Denier" defines the density and diameter of the mono-filament. The first number represents the number of twists per inch, and the second number refers to the number of filaments that are twisted in an inch.

The woven fabric is placed in a mold that preferably has the same dimensions as the stainless steel belt described above. A clear urethane resin is poured into the mold under a vacuum, and the assembly is then baked, de-molded, cured, and ground to the desired dimension. The resin may be mixed with fillers or abrasives in order to achieve desired material properties and/or polishing characteristics. Since fillers and abrasive particles in the polishing layer may scratch the polished article, it is desired that their average particle size be less than about 100 microns.

Instead of molding and baking the woven fabric with urethane, a layer of polishing material, preferably a Rodel IC 1000 polishing pad, can be attached to the woven fabric or the preconstructed belt as it was on the stainless steel belt.

In any of these belt constructions, fillers and/or abrasive particles (having an average particle size preferably less than 100 microns) can be dispersed throughout the polishing layer to enable use of lower concentration of abrasive particles in the polishing agent. The reduction of abrasive particle concentration in the polishing agent leads to substantial cost savings (typically, polishing agent costs represent 30–40% of the total cost of CMP processes). It also leads to a reduction in light scattering due to the presence of polishing agent particles. This reduces noise in the signal obtained by the monitor and helps in getting more accurate and repeatable results.

The polishing layer also can comprise polishing agent transport channels. Such polishing agent transport channels from a texture or pattern in the form of grooves (depressions) etched or molded into the surface of the polishing layer. These grooves may be, for example, of rectangular, U-, or V-shape. Typically, these channels are less than 40 mils deep and less than 1 mm wide at the polishing layer's upper surface. The polishing agent transport channels are typically arranged in a pattern such that they run the length of the polishing surface. However, they may be arranged in any other pattern as well. The presence of these channels greatly enhances the transport of polishing agent between the polishing layer and wafer. This leads to improved polishing rates and uniformity across the wafer surface.

To place a window in a polishing device (including the polishing devices described above), a hole can be punched in the polishing device at the desired location to form the opening. Any of the windows described above then can be disposed within this opening and affixed to the polishing device. Alternatively, the window can be molded in the appropriate shape directly in the polishing device at the appropriate location. For example, if the polishing device is a linear belt with a stainless steel layer, the urethane resin can be cast in the desired location in the opening. A casting mold having a mirror-finished rubber lining can be placed on both sides of the cast window during the curing process. As another example, if the polishing device is a linear belt with a woven fabric layer, before placing the woven fabric in the mold, an opening can be made in the fabric and spacers can be positioned in the opening in the desired locations. After the baking process described above, the opening in the belt would contain the urethane monitoring window at the desired location.

As an alternative to placing openings in the polishing device, the window can be made integral with the polishing device. That is, the polishing device itself can be partially or completely made of a material substantially transparent to light within a selected range of optical wavelengths. In this alternative, the movable window comprises a portion of the integrated polishing device that is below the polishing surface. For a linear belt, each layer of fabric can be woven with Kevlar or some other material so as to provide openings in the fabric, or can be constructed with optically clear fiber. Clear urethane, for example, can then molded be onto the fabric in a manner described above.

As discussed above, the term "polishing device" includes, but is not limited to, polishing devices used in linear polishing tools, rotating polishing tools, and orbital polishing tools. Linear polishers are described in a patent application titled "Control of Chemical-Mechanical Polishing Rate Across A Wafer Surface;" Ser. No. 08/638,464; filed Apr. 26, 1996 and in a patent application titled "Linear Polisher and Method for Semiconductor Wafer Planarization;" Ser. No. 08/759,172; filed Dec. 3, 1996. U.S. Pat. No. 5,433,651 and European Patent Application No. EP 0 738 561 A1 describe rotating polishers, such as the rotating polisher 1200 illustrated in FIG. 12, that can be used for in-situ monitoring. U.S. Pat. No. 5,554,064 teaches the use of orbital polishers. Each of these references is hereby incorporated by reference. Those skilled in the art can apply the principles taught above in reference to linear polishing tools to rotating and orbital polishing tools.

For simplicity, the term "measurement sensor" in this specification and the following claims is intended broadly to encompass any device that can be used for in-situ monitoring of a wafer during CMP processing. The widest variety of devices can be used to gather information about the state of the wafer being polished. These devices include, but are not limited to, a light source, interferometer, ellipsometer, beam profile reflectometer, or optical stress generator. By using a measurement sensor, the end point of the CMP process can be determined by detecting when the last unwanted layer has been removed from the wafer or when a specified amount of material remains on the wafer. The measurement sensor also can be used to determine removal rate, removal rate variation, and average removal rate at any given circumference of a wafer. In response to these measurements, polishing parameters (e.g., polishing pressure, carrier speed, polishing agent flow) can be adjusted. In-situ measurement sensors used with rotating polishers are described in the U.S. Pat. No. 5,433,651 and European Patent Application No. EP 0 738 561 A1. In-situ measurement sensors used with linear polishers are described in U.S. patent application Ser. Nos. 08/865,028; 08/863,644; and 08/869,655 filed on May 28, 1997. Each of these references is hereby incorporated by reference.

The foregoing detailed description has described only a few of the many forms that this invention can take. Of course, many changes and modifications are possible to the preferred embodiments described above. For this reason it is intended that this detailed description be regarded as an illustration and not as a limitation of the invention. It is only the following claims, including all equivalents, that are intended to define the scope of this invention.

What is claimed is:

1. A chemical mechanical polishing element comprising:

a belt comprising a polishing surface, said belt formed in a closed loop; and a window comprising a first surface and movably disposed within said belt to move between first and second positions, said first surface being closer to said polishing surface in the second position than in the first position.

2. In a linear chemical mechanical polisher of the type comprising: at least two rollers, a belt comprising a polishing surface, said belt mounted to extend between the rollers such that rotation of the rollers drives the belt, and a wafer carrier positioned adjacent the belt to press a wafer into contact with the belt intermediate the rollers, the improvement comprising:

a window comprising a first surface and movably disposed within said belt to move between first and second positions, said first surface being closer to the polishing surface in the second position than in the first position, said window positioned to move intermittently into alignment with the wafer as the belt is driven by the rollers.

3. The invention of claim 1 or 2, wherein said first surface is substantially flush with said polishing surface in the second position.

4. The invention of claim 1 or 2, further comprising a flexible diaphragm coupling said window with said belt.

5. The invention of claim 1 or 2, wherein said window comprises a single-piece window.

6. The invention of claim 1 or 2, wherein said window comprises a flat-sheet window.

7. The invention of claim 1 or 2, wherein said window comprises a sliding window.

8. The invention of claim 1 or 2, wherein said window comprises a bellows window.

9. The invention of claim 1 or 2, wherein said window is affixed to said belt.

10. The invention of claim 1 or 2, wherein said window is integral with said belt.

11. The invention of claim 1 or 2, wherein said window is molded in said belt.

12. The invention of claim 2, further comprising a window displacement mechanism operative to move said window from the first to the second position.

13. The invention of claim 2, further comprising a fluid platen operative to move said window from the first to the second position.

14. The invention of claim 2, further comprising a window displacement mechanism operative to move said window from the second to the first position.

15. The invention of claim 2, further comprising an in-situ measuring device coupled with said polisher.

16. A chemical mechanical polishing element comprising:

a rotating platen comprising a polishing surface; and a window comprising a first surface and movably disposed within said platen to move between first and second positions, said first surface being closer to said polishing surface in the second position than in the first position.

17. In a chemical mechanical polisher of the type comprising: a rotating platen comprising a polishing surface, means for moving the platen along a rotating polishing path, and a wafer carrier positioned adjacent the polishing element to press a wafer against the polishing surface during a polishing operation; the improvement comprising:

a window comprising a first surface and movably disposed within said rotating platen to move between first and second positions, said first surface being closer to said polishing surface in the second position than in the first position, said window positioned to move intermittently into alignment with the wafer during the polishing operation.

18. A chemical mechanical polishing element comprising:

an orbital platen comprising a polishing surface; and a window comprising a first surface and movably disposed within said platen to move between first position and second positions, said first surface being closer to said polishing surface in the second position than in the first position.

19. In a chemical mechanical polisher of the type comprising: an orbital platen comprising a polishing surface, means for moving the platen along an orbital polishing path, and a wafer carrier positioned adjacent the platen element to press a wafer against the polishing surface during a polishing operation; the improvement comprising:

a window comprising a first surface and movably disposed within said platen movable between first and second positions, said first surface being closer to said polishing surface in the second position than in the first position, said window positioned to move intermittently into alignment with the wafer during the polishing operation.

20. The invention of claim 16, 17, 18, or 19, wherein said first surface is substantially flush with said polishing surface in the second position.

21. The invention of claim 16, 17, 18, or 19, further comprising a flexible diaphragm coupling said window with said platen.

22. The invention of claim 16, 17, 18, or 19, wherein said window comprises a single-piece window.

23. The invention of claim 16, 17, 18, or 19, wherein said window comprises a flat-sheet window.

24. The invention of claim 16, 17, 18, or 19, wherein said window comprises a sliding window.

25. The invention of claim 16, 17, 18, or 19, wherein said window comprises a bellows window.

26. The invention of claim 16, 17, 18, or 19, wherein said window is affixed to said platen.

27. The invention of claim 16, 17, 18, or 19, wherein said window is integral with said platen.

28. The invention of claim 16, 17, 18, or 19, wherein said window is molded in said platen.

29. The invention of claim 17 or 19, further comprising a window displacement mechanism operative to move said window from the first to the second position.

30. The invention of claim 17 or 19, further comprising a fluid platen operative to move said window from the first to the second position.

31. The invention of claim 17 or 19, further comprising a window displacement mechanism operative to move said window from the second to the first position.

32. The invention of claim 17 or 19, further comprising an in-situ measuring device coupled with said polisher.

33. The invention of claim 1, 2, 16, 17, 18, or 19, wherein said first surface is below a pad cutting surface of a pad conditioner in the first position.

34. The invention of claim 1, 2, 16, 17, 18, or 19, wherein said first surface of said window comprises a slurry-phobic material.

35. A method for in-situ monitoring of a wafer while polishing the wafer with a polishing device comprising a polishing surface, said method comprising the steps of:

(a) providing a polishing device comprising a polishing surface and a window, said window movably disposed within said polishing device to move toward and away from said polishing surface; then (b) moving said window toward the polishing surface; then (c) performing an in-situ measurement of said wafer; and then (d) moving said window away from the polishing surface.

* * * * *

UNITED STATES PATENT AND TRADEMARK OFFICE

CERTIFICATE OF CORRECTION

PATENT NO. : 6,068,539
DATED : May 30, 2000
INVENTOR(S) : Rajeev Bajaj et al.

It is certified that error appears in the above-identified patent and that said Letters Patent is hereby corrected as shown below:

Title page,
Column 1,
After line 8, under "U.S. PATENT DOCUMENTS", insert the following:
-- 4,710,030 12/1987 Tauc et al. --. And
After line 18, Under "U.S. PATENT DOCUMENTS", insert the following:
-- 5,609,517 3/1997 Lofaro. -- .
After line 2, under "FOREIGN PATENT DOCUMENTS", insert the following:
-- 0 806 266 A2 11/1997 -- European Pat. Off.
0 824 995 A1 2/1998 European Pat Off.

Column 2,
After line 1, insert the following:
-- WO 98/114306 4/1998 PCT.
070 52032 2/1998 Japanese Abst. --.
After line 20, under "OTHER PUBLICATIONS", insert the following:

EPO Search Report and Annex with "Lack of Unity of Invention - sheet B' for EP 98304242.

EPO Search Report and Annex for EP 98304212. -- .

Signed and Sealed this

Thirteenth Day of November, 2001

*Attest:*

Nicholas P. Godici

NICHOLAS P. GODICI
*Acting Director of the United States Patent and Trademark Office*

*Attesting Officer*